US006987254B2

(12) United States Patent
Jeong

(10) Patent No.: US 6,987,254 B2
(45) Date of Patent: Jan. 17, 2006

(54) MICROWAVE OVEN

(75) Inventor: Sang Jin Jeong, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/636,998

(22) Filed: Aug. 8, 2003

(65) Prior Publication Data

US 2004/0134907 A1 Jul. 15, 2004

(30) Foreign Application Priority Data

Jan. 9, 2003 (KR) ..... 10-2003-0001430

(51) Int. Cl.
*H05B 6/64* (2006.01)

(52) U.S. Cl. ..... 219/756; 219/760

(58) Field of Classification Search ..... 219/756, 219/679, 760, 715; 336/183, 206, 160, 182, 336/98, 61, 255; F24C 15/00, 15/08, 7/02
See application file for complete search history.

(56) References Cited

FOREIGN PATENT DOCUMENTS

| | | | |
|---|---|---|---|
| GB | 2 230 388 | | 10/1990 |
| JP | 63-281381 | | 5/1987 |
| JP | 62-272492 | | 11/1987 |
| JP | 63-178483 | | 7/1988 |
| JP | 2000-123966 | | 4/2000 |
| KR | 20-208891 | | 1/1999 |
| KR | 99026282 A | * | 4/1999 |
| KR | 2001010252 A | * | 2/2001 |

OTHER PUBLICATIONS

Patent Abstract of Japan, Pub. No. 63281381, Nov. 17, 1988.
Derwent Publications Ltd., (Corresponds to JP'483).
Derwent Publications Ltd., (Corresponds to JP'492).

* cited by examiner

*Primary Examiner*—Quang T. Van
(74) *Attorney, Agent, or Firm*—Staas & Halsey LLP

(57) ABSTRACT

A microwave oven to prevent a side plate of a cabinet from vibrating due to an electromagnetic field which is generated around a high-voltage transformer installed in a machine room. An anti-vibration plate is provided at a predetermined position inside the side plate of the cabinet so as to prevent the side plate from vibrating due to the electromagnetic field. The anti-vibration plate extends from a rear wall of the machine room so as to be adjacent to the side plate at a position between the high-voltage transformer and the side plate. Further, the anti-vibration plate is integrated with the rear wall of the machine room, and is screwed to the side plate. The anti-vibration plate has a rectangular shape. An embossment is formed on the anti-vibration plate to reinforce a strength of the anti-vibration plate.

22 Claims, 3 Drawing Sheets

MICROWAVE OVEN

CROSS-REFERENCE TO RELATED APPLICATION

This application claims the benefit of Korean Application No. 2003-1430, filed Jan. 9, 2003, in the Korean Intellectual Property Office, the disclosure of which is incorporated herein by reference.

BACKGROUND OF THE INVENTION

1. Field of the Invention

The present invention relates, in general, to microwave ovens and, more particularly, to a microwave oven which is provided with an anti-vibration plate to prevent a side plate of a cabinet from vibrating, due to an electromagnetic field which is generated around a high-voltage transformer installed in a machine room.

2. Description of the Related Art

As is well known to those skilled in the art, a microwave oven is an appliance, which heats and/or cooks food placed in a cooking cavity thereof using high-frequency electromagnetic waves generated by an oscillation of a magnetron installed in a machine room. That is, during a cooking process, the magnetron installed in the machine room irradiates high-frequency electromagnetic waves, (i.e., microwaves), into the cooking cavity. The microwaves penetrate the food so as to repeatedly change a molecular arrangement of water laden in the food, thus causing molecules of the water to vibrate and generating frictional heat within the food to cook the food. Such microwave ovens are typically classified into two types, a general type microwave oven and a wall-mounted type microwave oven. The general type microwave oven is installed at a position around a cupboard in a kitchen to cook the food using the microwaves. The wall-mounted type microwave oven is mounted to a wall of the kitchen, and collaterally serves to exhaust gas or smoke produced from a gas oven range which is positioned under the wall-mounted type microwave oven, in addition to cooking the food in the wall-mounted microwave oven.

The present invention may be applied to both the general type microwave oven and the wall-mounted type microwave oven, but the present invention will be described herein with reference to the wall-mounted type microwave oven, as an example.

FIG. 1 illustrates a conventional wall-mounted type microwave oven. As illustrated in FIG. 1, the conventional wall-mounted type microwave oven includes a cabinet 1 which defines an external appearance of the wall-mounted type microwave oven. The cabinet 1 is partitioned into a cooking cavity 11 and a machine room 12.

An exhaust passage 13 is defined around lower portions and rear portions of the cooking cavity 11 and the machine room 12 to guide exhaust gas or smoke produced from a gas oven range (not shown) placed below the cabinet 1 so that the exhaust gas or the smoke is discharged to an outside. A fan motor 14 and two exhaust fans 15 are provided at an upper portion in a rear portion of the cabinet 1 to suck gas or smoke guided along the exhaust passage 13 and discharge the gas or smoke to the outside. In this case, the exhaust fans 15 are mounted to opposite ends of the fan motor 14.

The cabinet 1 has a front plate 2, a rear plate 3, a bottom plate 4, a top plate 5, and side plates 6 and 7. The front, rear and bottom plates 2, 3, and 4 are made of a thick steel plate, and are assembled with each other to define the cooking cavity 11 and the machine room 12. Further, a thin steel plate is bent at a right angle at opposites sides thereof to form the top and side plates 5, 6, and 7, having a single structure. The top and side plates 5, 6, and 7 cover open top and sides of the front, rear, and bottom plates 2, 3, and 4.

Electrical devices, such as a magnetron 21 and a high-voltage transformer 22, and a cooling fan 16 to cool the electrical devices are installed in the machine room 12. The high-voltage transformer 22 is mounted to a bottom of the machine room 12. The magnetron 21 is provided at an upper portion of the machine room 12.

Thus, when an electric current is supplied to the electrical devices including the magnetron 21 and the high-voltage transformer 22, microwaves are irradiated from the magnetron 21 into the cooking cavity 11 to cook food placed in the cooking cavity 11.

However, the conventional microwave oven has a problem that the top plate 5 and side plates 6 and 7 are made of a thin steel plate to have the single structure and the right side plate 7 covers a side of the machine room 12, so the right side plate 7 may vibrate due to an electromagnetic field which is generated when the electrical devices installed in the machine room 12 are operated to cause a noise.

That is, when the electric current is applied to the magnetron 21 and the high-voltage transformer 22, a strong electromagnetic field is formed around the high-voltage transformer 22 and due to the strong electromagnetic field, the thin right side plate 7 vibrates, thus generating the noise.

SUMMARY OF THE INVENTION

Accordingly, it is an aspect of the present invention to provide a microwave oven, which prevents a side plate of a cabinet from vibrating due to an electromagnetic field which is generated around a high-voltage transformer installed in a machine room.

Additional aspects and/or advantages of the invention will be set forth in part in the description which follows and, in part, will be obvious from the description, or may be learned by practice of the invention.

The above and/or other aspects of the present invention are achieved by providing a microwave oven, having a cabinet provided with a side plate, a machine room covered at a side thereof with the side plate, and a magnetron and a high-voltage transformer installed in the machine room, comprising an anti-vibration plate provided at a predetermined position inside the side plate to[, thus] prevent the side plate from vibrating due to an electromagnetic field which is generated around the high-voltage transformer.

The anti-vibration plate extends from a rear wall of the machine room so as to be arranged adjacent to the side plate at a position between the high-voltage transformer and the side plate.

The anti-vibration plate may be integrated with a rear wall of the machine room into a single structure.

The anti-vibration plate is screwed to the side plate.

Further, the anti-vibration plate has a rectangular shape, with an embossment being formed on the anti-vibration plate to reinforce a strength of the anti-vibration plate.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENT

Figure 1:
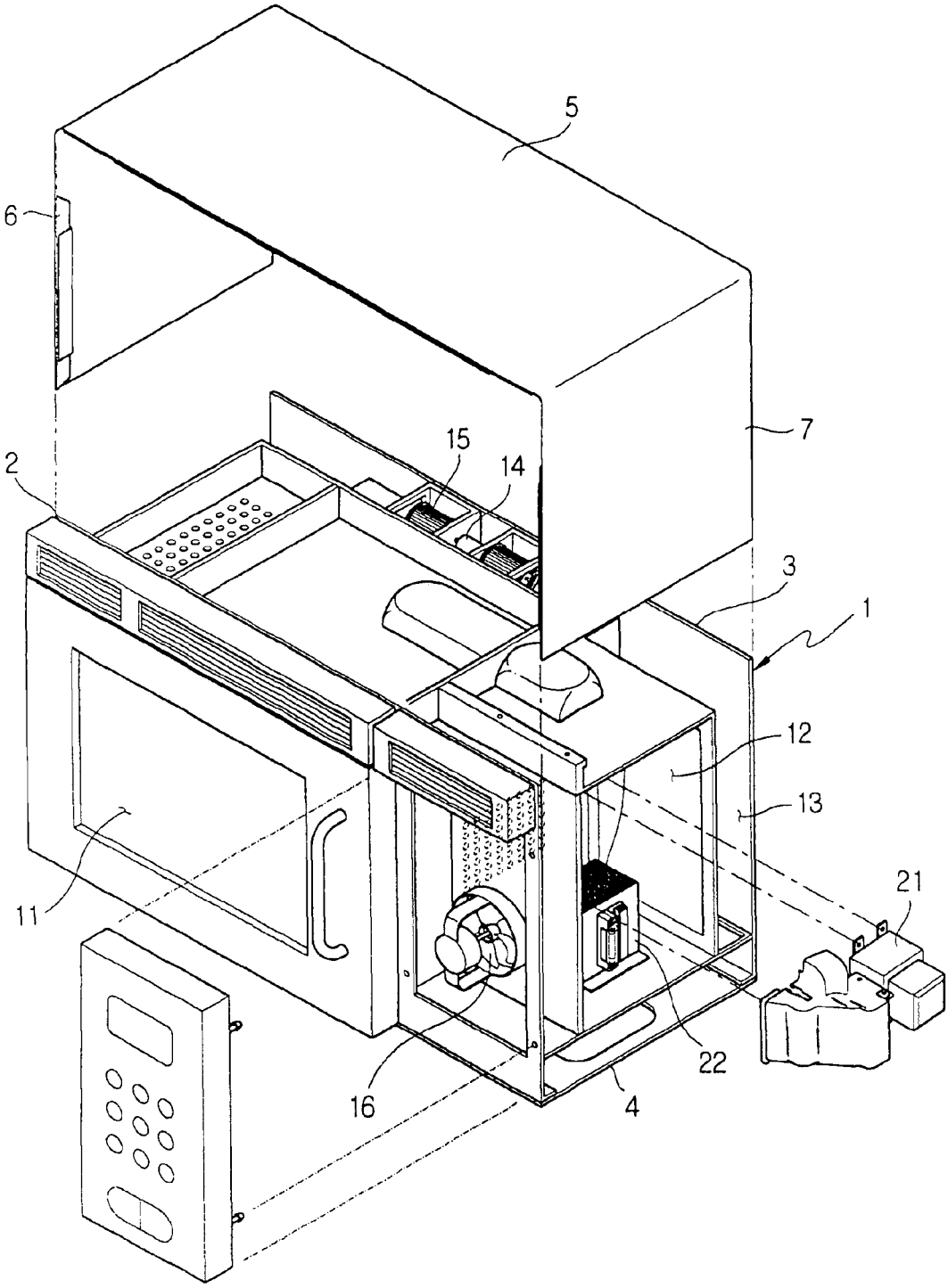
FIG. 1 (Prior art)
FIG. 1 is an exploded perspective view of a conventional microwave oven.

Reference will now be made in detail to the present preferred embodiment of the present invention, examples of which are illustrated in the accompanying drawings, wherein like reference numerals refer to like elements throughout.

Figure 2:
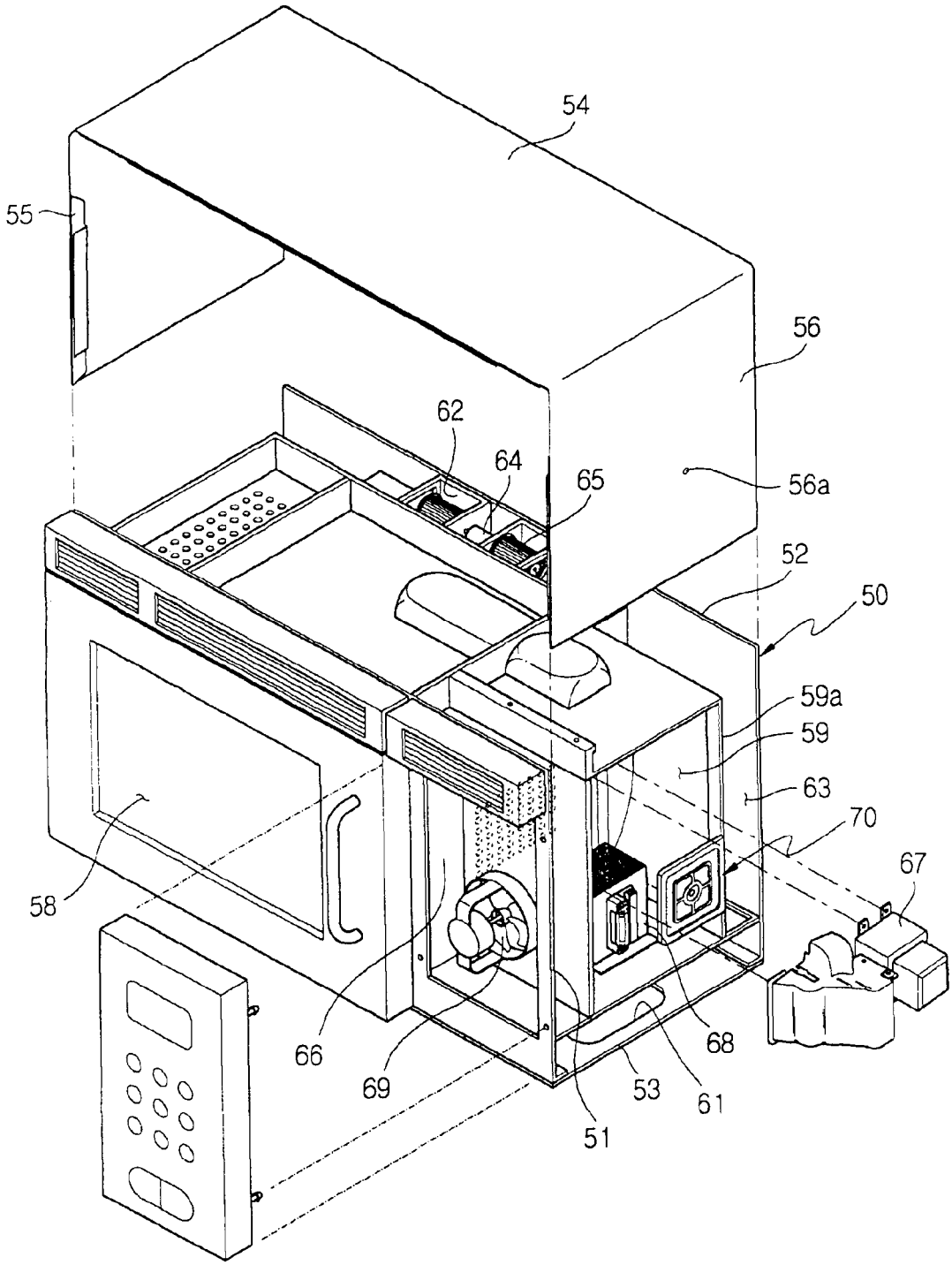
FIG. 2 is an exploded perspective view of a microwave oven, according to an embodiment of the present invention.
Figure 3:
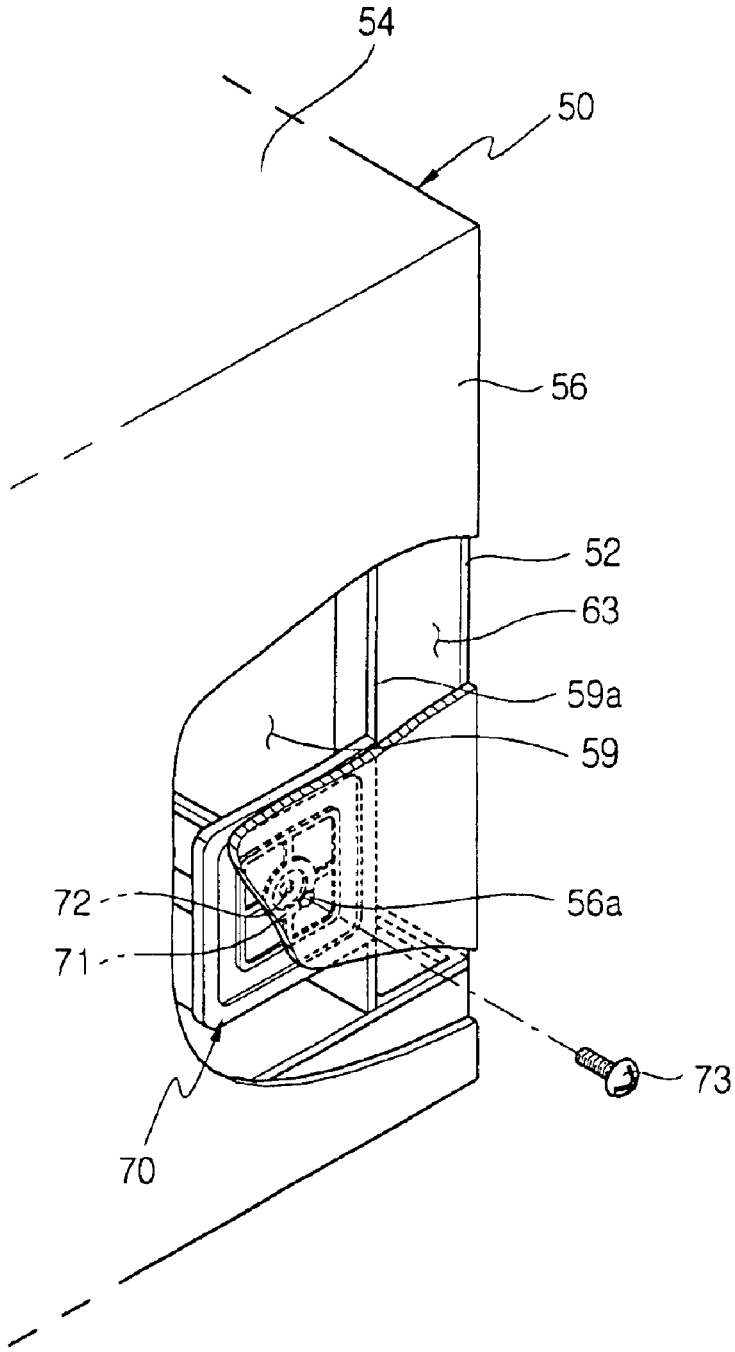
FIG. 3 is a partially perspective view of the microwave oven, for illustrating an anti-vibration plate of FIG. 2 mounted to a side plate of a cabinet.

FIG. 2 is an exploded perspective view of a microwave oven, according to an embodiment of the present invention. FIG. 3 is a partial perspective view of the microwave oven for illustrating an anti-vibration plate of FIG. 2 mounted to a side plate of a cabinet.

As illustrated in FIG. 2, the wall-mounted type microwave oven includes a cabinet 50 which is box-shaped and defines an external appearance of the wall-mounted microwave oven. A front plate 51, a rear plate 52, a bottom plate 53, and a top plate 54 and side plates 55 and 56 which cover top and sides of the front, rear and bottom plates 51, 52 and 53, respectively, are assembled with each other to form the box-shaped cabinet 50.

The front, rear, and bottom plates 51, 52 and 53, respectively, are thicker than the top and side plates 54, 55 and 56, thus having a higher strength than that the top and side plates 54, 55 and 56. A cooking cavity 58 and a machine room 59 are provided in a space defined by the front, rear, and bottom plates 51, 52 and 53, respectively, so that the cooking cavity 58 and the machine room 59 are partitioned from each other.

Further, the top and side plates 54, 55 and 56 are integrally manufactured by bending sides of a somewhat thin steel plate at a right angle to accomplish a high efficiency production and assembly operation. Thus, the top and side plates 54, 55, and 56 have a relatively low resistance to an impact and a vibration.

Two inlet ports 61 are formed on opposite sides of the bottom plate 53 to suck exhaust gas and food odors produced from a gas oven range (not shown) into the cabinet 50. An outlet port 62 is provided at an upper portion of the cabinet 50 to discharge the exhaust gas and the food odors from the cabinet 50 to an outside.

Further, the inlet ports 61 and the outlet port 62 communicate with each other through an exhaust passage 63 which is defined by rear portions of the cooking cavity 58 and the machine room 59, the rear plate 52 and the top plate 54 of the cabinet 50. Thus, the exhaust gas sucked into the inlet ports 61 passes through the exhaust passage 63 and is discharged to the outside through the outlet port 62. A fan motor 64 and two exhaust fans 65 are provided at the outlet port 62 to suck the exhaust gas which is sucked into the inlet ports 61. The exhaust fans 65 are mounted to opposite ends of the fan motor 64.

The machine room 59 is partitioned from the cooking cavity 58 by a partition wall 66. A magnetron 67 to generate microwaves, a high-voltage transformer 68, and a cooling fan 69 to cool the magnetron 67 and the high-voltage transformer 68 are installed in the machine room 59. The cooling fan 69 is installed at a front portion of the machine room 59. The magnetron 67 is mounted to an upper portion of the partition wall 66, and the high-voltage transformer 68 is mounted to a bottom of the machine room 59.

An anti-vibration plate 70 is provided at a rear wall 59*a* of the machine room 59 to prevent noise and vibration from being generated at the side plate 56 of the cabinet 50 due to an electromagnetic field which is generated by the electrical devices installed in the machine room 59.

The anti-vibration plate 70 is integrally provided at a lower portion of an edge of the rear wall 59*a* of the machine room 59 at a right angle to the rear wall 59*a* of the machine room 59. That is, the anti-vibration plate 70 extends in a forward direction from the rear wall 59*a* of the machine room 59 such that the anti-vibration plate 70 is arranged at a position between the high-voltage transformer 68 which is provided on the bottom of the machine room 59 and the side plate 56 of the cabinet 50.

As illustrated in FIG. 3, an embossment 71 is formed on the anti-vibration plate 70 to reinforce a strength of the anti-vibration plate 70. A screw hole 72 is formed at a center of the anti-vibration plate 70. Further, a screw hole 56*a* is bored in the side plate 56 of the cabinet 50 to correspond to the screw hole 72 of the anti-vibration plate 70, so that the anti-vibration plate 70 is mounted to the side plate 56 using a screw 73 so as to be provided at a predetermined position inside the side plate 56.

The anti-vibration plate 70 is firmly screwed to the side plate 56 of the cabinet 50 at a position facing the high-voltage transformer 68, thus reinforcing a strength of the side plate 56.

When the wall-mounted type microwave oven is operated to supply an electric current to the electrical devices including the magnetron 67 and the high-voltage transformer 68, the microwaves are irradiated from the magnetron 67 into the cooking cavity 58 to cook the food placed in the cooking cavity 58. When the magnetron 67 and the high-voltage transformer 68 are operated, a strong electromagnetic field is generated around the high-voltage transformer 68 and due to the electromagnetic field, the vibration and the noise may be generated at the side plate 56 of the cabinet 50. However, the anti-vibration plate 70 is provided at the predetermined position inside the side plate 56 to reinforce the strength of the side plate 56 to prevent the side plate 56 from vibrating.

As is apparent from the above description, a microwave oven is provided with an anti-vibration plate at a predetermined position inside a side plate of a cabinet to face a high-voltage transformer, thus preventing a vibration and a noise from being generated at the side plate due to an electromagnetic field which is generated around the high-voltage transformer.

Further, in a microwave oven, an anti-vibration plate to prevent a vibration from being generated at a side plate of a cabinet is integrated with a rear wall of a machine room into a single structure, so it is unnecessary to separately manufacture the anti-vibration plate.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A microwave oven, having a cabinet provided with a side plate, a machine room covered at a side thereof with the side plate, and a magnetron and a high-voltage transformer installed in the machine room, the microwave oven comprising:

an anti-vibration plate provided at a predetermined position inside the side plate to prevent the side plate from vibrating due to an electromagnetic field which is generated around the high-voltage transformer; and an embossment, formed on the anti-vibration plate, to reinforce a strength of the anti-vibration plate.

2. The microwave oven according to claim 1, wherein the embossment has a rectangular shape.

3. The microwave oven according to claim 1, wherein the anti-vibration plate is firmly coupled to the side plate at a position facing the high-voltage transformer to reinforce a strength of the side plate.

4. The microwave oven according to claim 1, wherein the anti-vibration plate prevents a vibration and a noise from being generated at the side plate due to an electromagnetic field which is generated around the high-voltage transformer.

5. The microwave oven according to claim 1, wherein the anti-vibration plate and the side plate are provided as one constructional unit.

6. A microwave oven, having a cabinet provided with a side plate, a machine room covered at a side thereof with the side plate, and a magnetron and a high-voltage transformer installed in the machine room, the microwave oven comprising:

an anti-vibration plate provided at a predetermined position inside the side plate to prevent the side plate from vibrating due to an electromagnetic field which is generated around the high-voltage transformer, wherein the machine room comprises:

a rear wall; and the anti-vibration plate extends from the rear wall of the machine room so as to be arranged adjacent to the side plate at a position between the high-voltage transformer and the side plate.

7. The microwave oven according to claim 6, wherein the anti-vibration plate is integrated with the rear wall of the machine room into a single structure.

8. The microwave oven according to claim 7, where the anti-vibration plate is screwed to the side plate.

9. The microwave oven according to claim 6, wherein the anti-vibration plate is screwed to the side plate.

10. A microwave oven, having a cabinet provided with a side plate, a machine room covered at a side thereof with the side plate, and a magnetron and a high-voltage transformer installed in the machine room, the microwave oven comprising:

an anti-vibration plate provided at a predetermined position inside the side plate to prevent the side plate from vibrating due to an electromagnetic field which is generated around the high-voltage transformer, wherein the anti-vibration plate is integrally provided at a lower portion of an edge of the rear wall of the machine room at a right angle to the rear wall of the machine room.

11. A microwave oven, having a cabinet provided with a side plate, a machine room covered at a side thereof with the side plate, and a magnetron and a high-voltage transformer installed in the machine room, the microwave oven comprising:

an anti-vibration plate provided at a predetermined position inside the side plate to prevent the side plate from vibrating due to an electromagnetic field which is generated around the high-voltage transformer, wherein the anti-vibration plate extends in a forward direction from the rear wall of the machine room such that the anti-vibration plate is arranged at a position between the high-voltage transformer and the side plate.

12. A microwave oven, having a cabinet provided with a side plate, one or more vibration producing devices installed in a vicinity of the side plate, comprising:

an anti-vibration unit provided inside of the side plate at a predetermined position to prevent the side plate from vibrating due to a vibration from the vibration producing devices; and an embossment, formed on the anti-vibration unit reinforce a strength of the anti-vibration plate.

13. The microwave oven according to claim 12, wherein the embossment has a rectangular shape.

14. The microwave oven according to claim 12, wherein the anti-vibration unit is fixedly coupled to the side plate at a position facing the vibration producing devices to reinforce a strength of the side plate.

15. The microwave oven according to claim 12, wherein the anti-vibration unit prevents a vibration and a noise from being generated at the side plate due to vibration producing devices.

16. The microwave oven according to claim 12, wherein the anti-vibration unit and the side plate are provided as one constructional unit.

17. A microwave oven, having a cabinet provided with a side plate, one or more vibration producing devices installed in a vicinity of the side plate, comprising:

an anti-vibration unit provided inside of the side plate at a predetermined position to prevent the side plate from vibrating due to a vibration from the vibration producing devices;

a rear wall; and the anti-vibration unit extends from the rear wall so as to be arranged adjacent to the side plate at a position between the vibration producing devices and the side plate.

18. The microwave oven according to claim 17, wherein the anti-vibration unit is integrated with the rear wall of the machine room into a single structure.

19. The microwave oven according to claim 17, wherein the anti-vibration unit is screwed to the side plate.

20. A microwave oven, having a cabinet provided with a side plate, one or more vibration producing devices installed in a vicinity of the side plate, comprising:

an anti-vibration unit provided inside of the side plate at a predetermined position to prevent the side plate from vibrating due to a vibration from the vibration producing devices, wherein the anti-vibration unit is integrally provided at a lower portion of an edge of a rear wall of the microwave oven at a right angle to the rear wall.

21. A microwave oven, having a cabinet provided with a side plate, one or more vibration producing devices installed in a vicinity of the side plate, comprising:

an anti-vibration unit provided inside of the side plate at a predetermined position to prevent the side plate from vibrating due to a vibration from the vibration producing devices, wherein the anti-vibration unit extends in a forward direction from a rear wall of the microwave oven such that the anti-vibration unit is arranged at a position between the vibration producing devices and the side plate.

22. A microwave oven, having a cabinet provided with a side plate, and one or more vibration producing devices installed in a vicinity of the side plate, the microwave oven comprising:

a strengthening unit provided inside the side plate at a predetermined position to prevent the side plate from vibrating due to a vibration from the vibration producing devices; and an embossment, formed on the strengthening unit, to reinforce a strength of the strengthening unit.

* * * * *

UNITED STATES PATENT AND TRADEMARK OFFICE

CERTIFICATE OF CORRECTION

PATENT NO. : 6,987,254 B2
APPLICATION NO. : 10/636998
DATED : January 17, 2006
INVENTOR(S) : Sang Jin Jeong It is certified that error appears in the above-identified patent and that said Letters Patent is hereby corrected as shown below:

On the title Page item (75), Col. 1 (Inventor), Line 1, delete "Suwon" and insert --Suwon-city-- therefor.
On the title Page item (73) Col. 1 (Assignee), Line 1, delete "Suwon" and insert --Suwon-si-- therefor.

Signed and Sealed this

Seventeenth Day of October, 2006

JON W. DUDAS
*Director of the United States Patent and Trademark Office*